United States Patent [19]

Andersson et al.

[11] Patent Number: 4,911,235

[45] Date of Patent: Mar. 27, 1990

[54] PLATE HEAT EXCHANGER

[75] Inventors: Jarl Andersson, Lund; Jan-Ove Bergqvist, Malmo, both of Sweden

[73] Assignee: Alfa-Laval Thermal AB, Tumba, Sweden

[21] Appl. No.: 343,298

[22] Filed: Apr. 26, 1989

Related U.S. Application Data

[63] Continuation-in-part of Ser. No. 209,579, Jun. 22, 1988, abandoned, which is a continuation-in-part of Ser. No. 52,038, May 7, 1987, abandoned.

[30] Foreign Application Priority Data

Sep. 23, 1985 [SE] Sweden ..... 8504379

[51] Int. Cl.[4] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 3,372,744 | 3/1968 | Skoog | 165/167 |
| 3,661,203 | 5/1972 | Mesher | 165/167 |

FOREIGN PATENT DOCUMENTS

| | | | |
|---|---|---|---|
| 46994 | 4/1981 | Japan | 165/166 |
| 992999 | 1/1983 | U.S.S.R. | 165/166 |
| 985955 | 3/1965 | United Kingdom | 165/167 |

*Primary Examiner*—Albert W. Davis, Jr.

*Attorney, Agent, or Firm*—Davis Hoxie Faithfull & Hapgood

[57] ABSTRACT

A plate heat exchanger especially adapted for viscous fluids or fluids containing fibers has spacing means extending above the normal corrugations thus widening the normal interplate channels and the inlets and outlets to and from said channels are formed by juxtaposing the plates containing ports forming said inlets and outlets to give the maximum throughflow.

2 Claims, 3 Drawing Sheets

PLATE HEAT EXCHANGER

This is a continuation-in-part of our pending application Ser. No. 0/209,579, filed June 22, 1988, now abandoned which application is a continuation-in-part of our application Ser. No. 052,038, filed May 7, 1987 now abandoned.

This invention relates to a plate heat exchanger comprising heat exchange plates mounted between a frame plate and a pressure plate in a frame, the heat exchanger plates forming channels between alternate plates for heat exchange media which are introduced into and taken out of the channels via ports in the corner portions of the plates, each heat exchange plate having two distributing areas and an intermediate heat exchange area and each plate having a pattern of spacing means, usually corrugations, pressed out of the plate, for inducing turbulence and for keeping adjacent plates spaced apart.

Such heat exchangers are common today for heat exchange between media of different temperatures.

However, there is a need in the market for a plate heat exchanger for highly viscous media and media of various viscosities containing fibers. In order to handle highly viscous or fiber containing media the channels of the heat exchanger have to be designed in a special way. In particular the inlet of the channels at the plate ports must have a design to permit free inflow of the medium into the interplate channels.

Plates in certain prior plate heat exchangers have a plate pattern comprising turbulence generating and spacing means at the area around the ports In this connection prior plates have been designed so that when the ports are cut out of the plate through the turbulence generating and spacing means the inlet of each channel, when two plates have been put together, has been composed of a number of cell-like openings. These cell-like openings have formed sharp edges for the inflowing medium, the consequence of which, if a medium containing fibers is used, is that the fibers lodge in the cell walls and shut off the inlet of the channels. Moreover, the cell-like openings into the channel tend to be too narrow for a highly viscous medium.

The object of this invention is to design the plates forming the channels in that way that the media can flow relatively freely through their respective channels. This object is achieved in a plate heat exchanger comprising a number of heat exchange plates mounted between a frame plate and a pressure plate and forming channels between adjacent plates for the throughflow of two heat exchange media, every second one of said channels being connected with an inlet and an outlet for a first medium and the other being connected with an inlet and outlet for a second medium, each of said plates having four ports and being provided with a pressed gasket groove on one of its sides enclosing only two of said ports and an intermediate heat exchange portion of the plate, a corrugation pattern of ridges and valleys being pressed in the heat exchange portion of each plate, which ridges cross and abut each other in the channels for the first heat exchange medium, all the gasket grooves in the plates being turned in the same direction and containing gaskets sealing adjacent plates; by providing spacing means pressed out of at least every second heat exchange plate into the channel for the second medium, said spacing means having a height above that of the corrugation pattern, and by placing the plate portions forming opposing ports outside of the gasket in each channel for said first medium in contact with each other to form as large throughflow areas as possible for the second medium near the ports situated inside the gaskets in the channels for the second medium. Specifically, it is preferred to locate the inlet and outlet ports of one plate in the top plane of that plate and to place in contact with that plate, the port portions of a plate having inlet and outlet ports formed in its bottom plane.

A preferred embodiment of the invention applicable to the heat exchange of media including one medium which is highly viscous will be described in more detail in connection with the accompanying drawings, in which.

Figure 1:
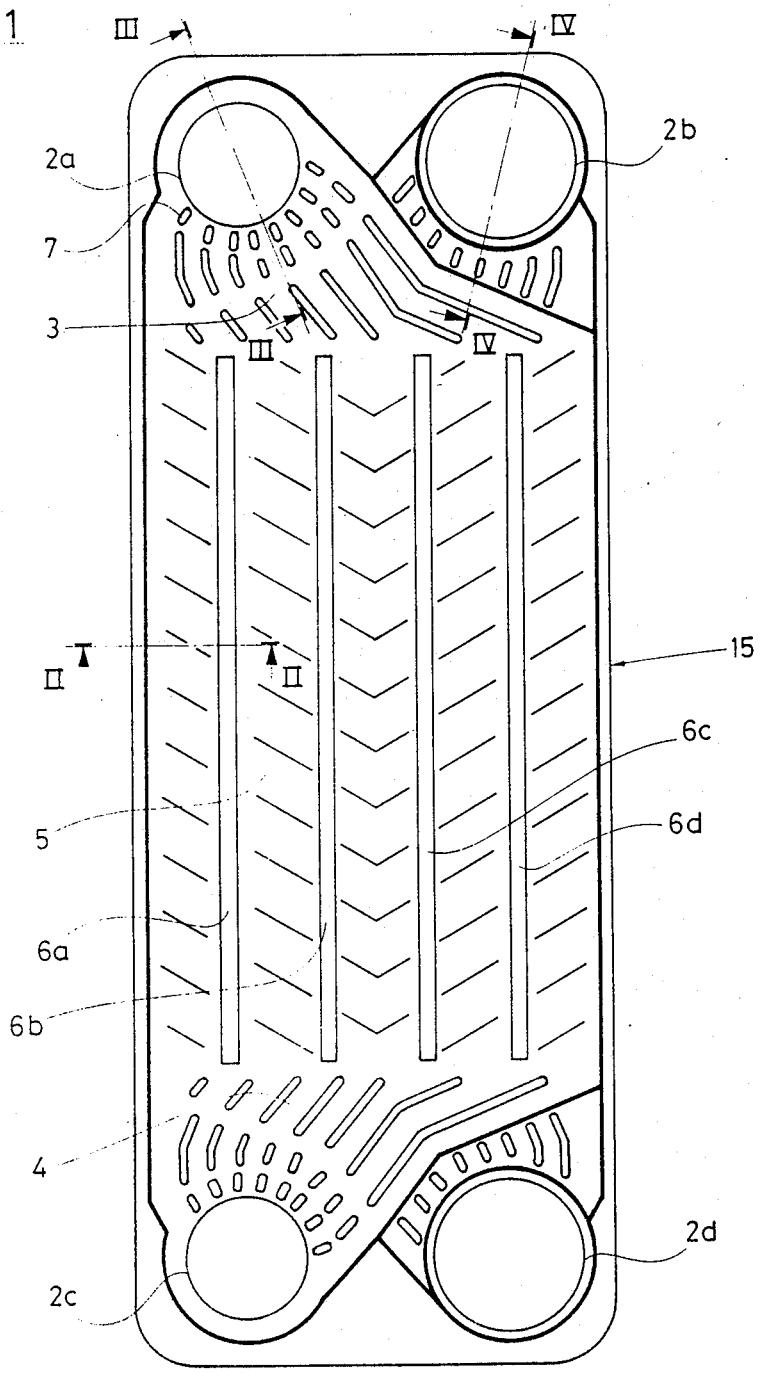
FIG. 1 shows a front elevational view of a heat exchange plate according to the invention.
Figure 2:
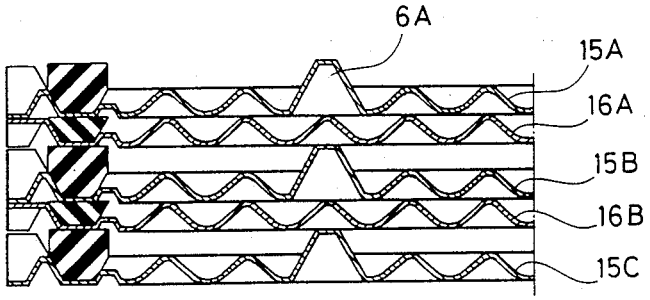
FIG. 2 shows a section along the line II—II in FIG. 1 of a stack of several plates in accordance with the invention.

The plate in FIG. 1 is provided in the conventional way with four ports 2A–D for the media to be heat exchanged. The plate is also provided with two distributing areas 3, 4 and a heating area 5. This heating area 5 is provided with special spacing means in the form of several ridges 6A–D which are parallel to one another and extend in the longitudinal direction of the plate, along essentially the whole heating area. These spacing means have a height exceeding the height of the spacing means in the ordinary plate pattern. Thus when a plate according to the invention such as is shown in FIG. 1 is matched with a conventional plate without the special spacing means, on the upper side of the plate, i.e. that having ridges 6A–D, a channel having a sufficient width for a highly viscous medium or a medium mixed with fibers is formed.

The ridges 6A–D are preferably positioned on only one side of the plate 1 and can be composed of folds or corrugations which have been pressed out of the plate.

Instead of being an integral part of the plate the ridges can be composed of separate parts which are welded or soldered to the plate.

Figure 3:
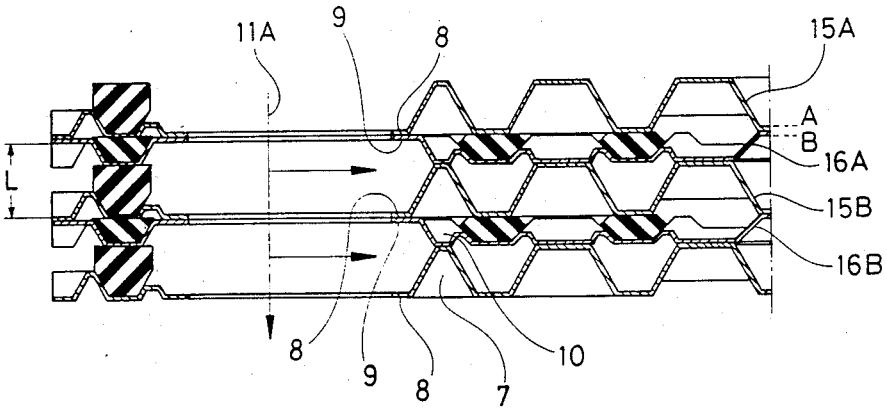
FIG. 3 shows a section along the line III—III in FIG. 1 of a stack of several plates in accordance with the invention.

In the distributing surfaces 3, 4 the ridge pattern is so designed that a part of the spacing means, is given a height corresponding to the height of the special spacing means 6A–D. Furthermore, at least a part of the spacing means 7 (as shown in FIG. 3) in the inlet and outlet portions of the channels, i.e., in the area close to the plate ports, also has a height corresponding to the height of the distance means *6a-d*. Thus the distance between the plates can be insured through the distributing areas and at the area close to the plate ports.

Figure 4:
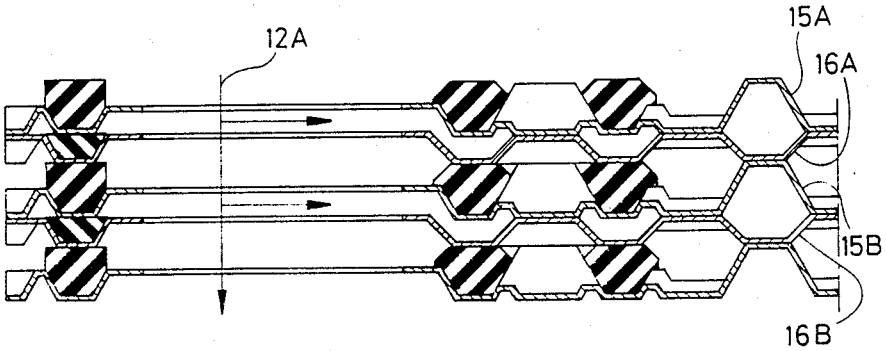
FIG. 4 shows a section along the line IV—IV in FIG. 1 of a stack of several plates in accordance with the invention.
Figure 5:
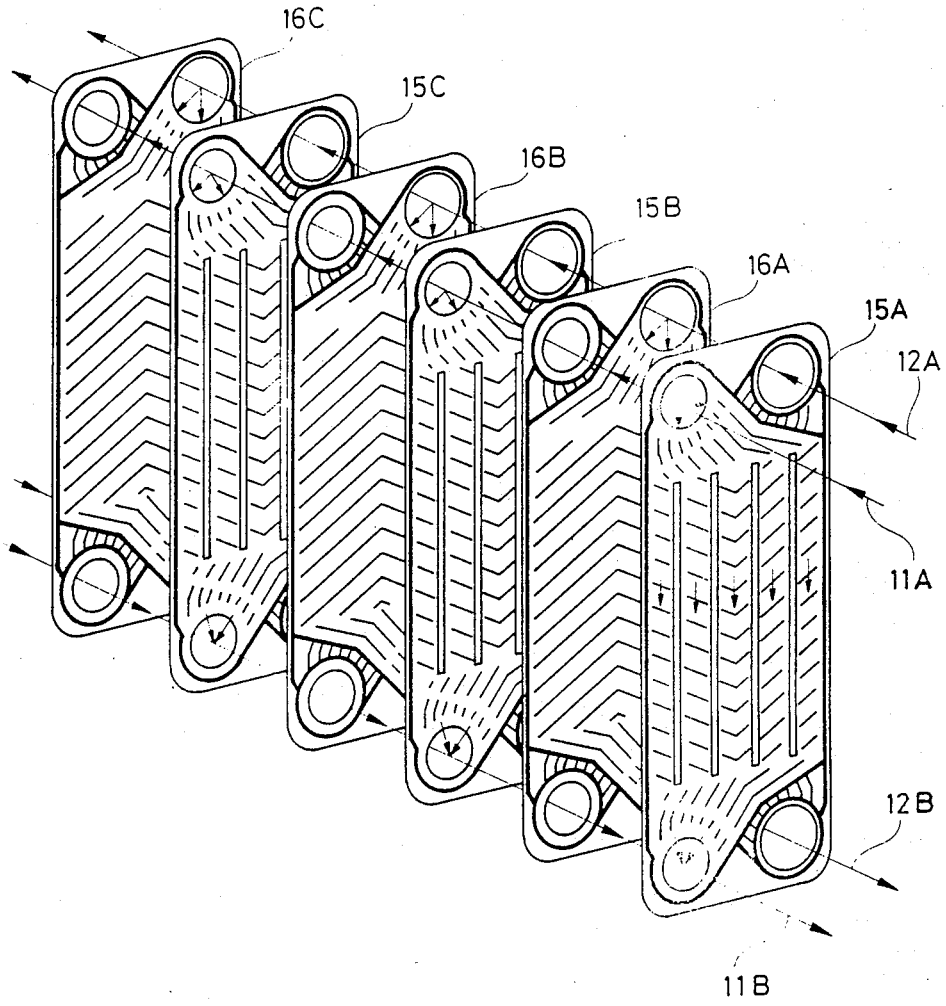
FIG. 5 is an exploded view showing the heat exchange plates in a heat exchanger according to the invention.

Referring to FIGS. 3, 4 and 5, the first medium is introduced as stream 12A and feeds the channel defined by plate 15A on one side and 16A on the other. The second medium, i.e., the highly viscous or fiber containing medium, stream 11A, feeds the channel defined by plate 16A on one side and 15B on the other. The outlet streams from the two channels ar shown at 11B and 12B respectively (FIG. 5). It will be understood that as to each channel, the ports carrying the other medium, i.e., the medium not carried by that channel, are outside the gasket which defines that channel. Thus, for example, referring to the channel between plates 15A and 16A, the ports carrying stream 11A are outside the gasket which encircles that channel and the port which feeds it. Thus, again considering the medium fed between plates 15A and 16A to be the first medium, the plate portions 8 and 9 which form a port outside the gasket for the first medium are located and placed in contact with each other in such a way as to form as large throughflow areas as possible for the second medium, i.e., that introduced at 11A, between plates 15B and 16A.

As has previously been mentioned the plates in prior plate heat exchangers have been so designed at the area of the ports, that the inlet leading to the channels has been composed of a cell pattern with sharp edges. There have been at least two drawbacks connected therewith. First, these sharp edges result in media containing fibers readily closing up the inlet to the channels. Second, these cells have a very limited inlet area, so that a highly viscous medium meets great flow resistance. These problems are solved, according to the invention, by giving the inlet the greatest possible width. This is brought about, as appears from FIG. 3, by giving the plates a special design at the area of the ports. Thus the port of one of the plates (8 shows the inner edge of the port), in this case the plate provided with the special spacing ridges, is placed in the bottom plane A of the plate, while the port of the adjacent plate (9 shows the inner edge of the port) is placed in its top plane B. Due to that fact the distance L (FIG. 3) between the two plates in the area of the ports, when the spacing means 7 in the distributing area of a plate according to the invention is matched with the spacing means 10 of a conventional plate, is as great as possible. This has the consequence that the inlet to the channel for the viscous medium becomes as great as possible so that inflow to the channel is facilitated. In FIGS. 3 and 5 the stream of viscous medium has been indicated as 11A.

Placing of the port in the two plates defining a channel for a viscous medium in the manner described results in the plates 15, 16 resting against each other at the port area between two inlets to the channels for the viscous medium.

As has been shown in FIG. 3 the spacing means 7, 10 are placed a short distance from the port edge 8, 9. This fact and the placing of the ports in bottom plane and top plane, respectively, result in a smooth transfer passage without sharp edges for the viscous medium from the port and into the channel between the plates 15, 16. Thus inflow of the viscous medium into the channel is facilitated even more.

Furthermore, from FIG. 3, it is apparent that the special spacing means 7 of the press pattern of a plate according to the invention rests against the spacing means 10 of the other plate. Thus the spacing means form contact points between the plates in the area close to the ports.

The invention is, of course, not limited to the described embodiment. Thus it is possible to heat exchange two highly viscous media of essentially the same viscosity. In this case the inlets to the channels for both media should be as wide as possible. This requires, besides having the port of one plate placed in its bottom plane and the port of the adjacent plate in its top plane, that the spacing means of the plates lying opposite each other have essentially the same height.

The spacing means 6 can also be unsymmetrically placed in relation to the longitudinal center line of the plate, whereby the plate becomes mixable with itself. A heat exchanger built up by such plates is suitable when the both media are highly viscous.

The special design of the plates at the area of the ports makes the heat exchanger particularly suitable for use with media which are contaminated in various ways, for instance by fibers.

What is claimed is:

1. In a plate heat exchanger comprising a number of heat exchange plates mounted between a frame plate and a pressure plate and forming channels between adjacent plates for the throughflow of two heat exchange media, every second one of said channels being connected with an inlet and an outlet for a first medium and the other being connected with an inlet and an outlet for a second medium, each of said plates having four ports and being provided with a pressed gasket groove on one of its sides enclosing only two of said ports and an intermediate heat exchange portion of the plate, a corrugation pattern of ridges and valleys being pressed in the heat exchange portion of each plate, which ridges cross and abut each other in the channels for said first heat exchange medium, all of the gasket grooves in the plates being turned in the same direction and containing gaskets sealing adjacent plates, the improvement comprising spacing means pressed out of at least every second one of the heat exchange plates into the channels for said second medium, said spacing means having a height above that of said corrugation pattern, plate portions forming opposing ports outside of the gasket defining each channel for said first medium being located and placed in contact with each other to form as large throughflow areas as possible for said second medium near the ports situated inside the gaskets defining the channels for said second medium.

2. The plate heat exchanger according to claim 1, and comprising elongated spacing means extending substantially between the two communicating ports in at least some of said channels.

* * * * *